United States Patent [19]

Fowler et al.

[11] 4,290,361

[45] Sep. 22, 1981

[54] ON THE FLY ADJUSTING MECHANISM FOR ROTARY PRINTING PRESSES

[75] Inventors: William H. Fowler, Allentown; Frederick L. Warner, Easton, both of Pa.

[73] Assignee: American Newspaper Publishers Association, Easton, Pa.

[21] Appl. No.: 111,410

[22] Filed: Jan. 11, 1980

[51] Int. Cl.[3] ..... B41F 5/06; B41F 5/12

[52] U.S. Cl. ..... 101/182; 101/247; 101/221

[58] Field of Search ..... 101/217, 218, 247, 179, 101/180, 181, 182, 183, 184, 185, 220, 221, 222, 223, 136, 137, 138, 139, 140, 143, 144, 145

[56] References Cited

U.S. PATENT DOCUMENTS

| | | | |
|---|---|---|---|
| 1,040,783 | 10/1912 | Scott | 101/184 |
| 1,924,625 | 8/1933 | Roesen | 101/220 |
| 2,278,312 | 3/1942 | Holtz | 101/218 |
| 2,855,846 | 10/1958 | Harless et al. | 101/218 |
| 2,874,636 | 2/1959 | Royer et al. | 101/218 |
| 3,054,346 | 9/1962 | Koch et al. | 101/218 |
| 3,067,674 | 12/1962 | Tyma, Jr. et al. | 101/218 |
| 3,452,672 | 7/1969 | Bolza-Schünemann | 101/177 |
| 3,473,469 | 10/1969 | Sipin | 101/217 |
| 3,527,165 | 9/1970 | Harless | 101/220 X |
| 3,691,956 | 9/1972 | James | 101/247 |
| 3,785,287 | 1/1974 | Dahlgren | 101/247 |
| 3,800,698 | 4/1974 | Kist et al. | 101/137 |
| 3,817,174 | 6/1974 | Paulson | 101/218 |
| 4,094,243 | 6/1978 | Braun | 101/218 X |
| 4,137,844 | 2/1979 | Paulson | 101/218 |

FOREIGN PATENT DOCUMENTS

| | | | |
|---|---|---|---|
| 221047 | 9/1924 | United Kingdom | 101/218 |
| 239604 | 9/1925 | United Kingdom | 101/218 |

*Primary Examiner*—J. Reed Fisher
*Attorney, Agent, or Firm*—David H. Semmes

[57] ABSTRACT

Rotary printing presses of the type embodying abutting plate cylinders and impression cylinders. Particularly, a bell crank mechanism pivotally mounted upon the press and connected to an eccentric bushing plate supporting the impression cylinder shaft, so as to apply impression or space the impression cylinder shaft with respect to the plate cylinder for web adjustment, repair, plate changes and the like without stopping the press.

3 Claims, 6 Drawing Figures

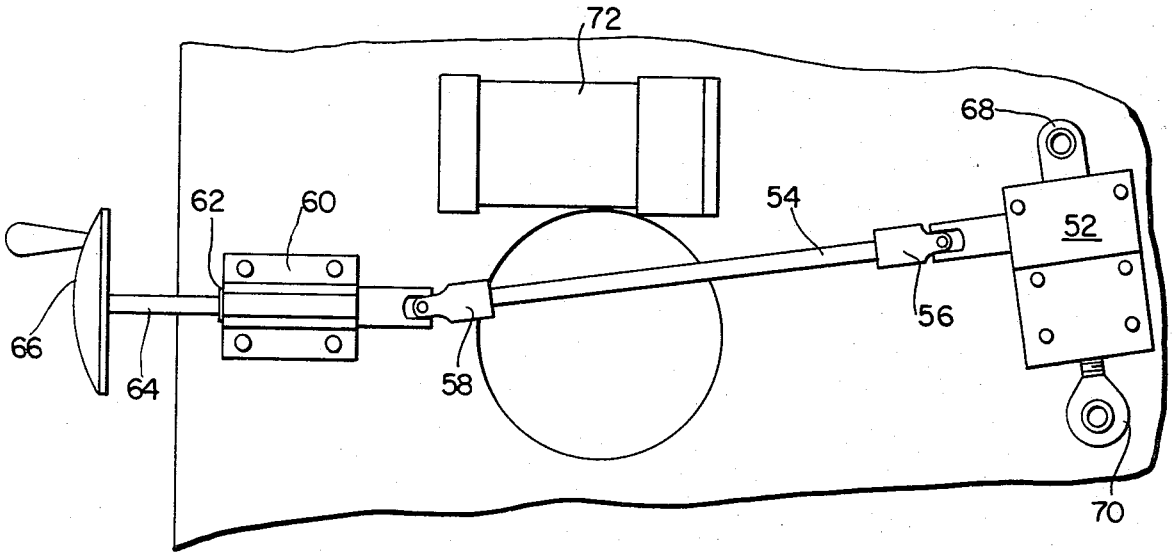
FIG. 3
FIG. 6
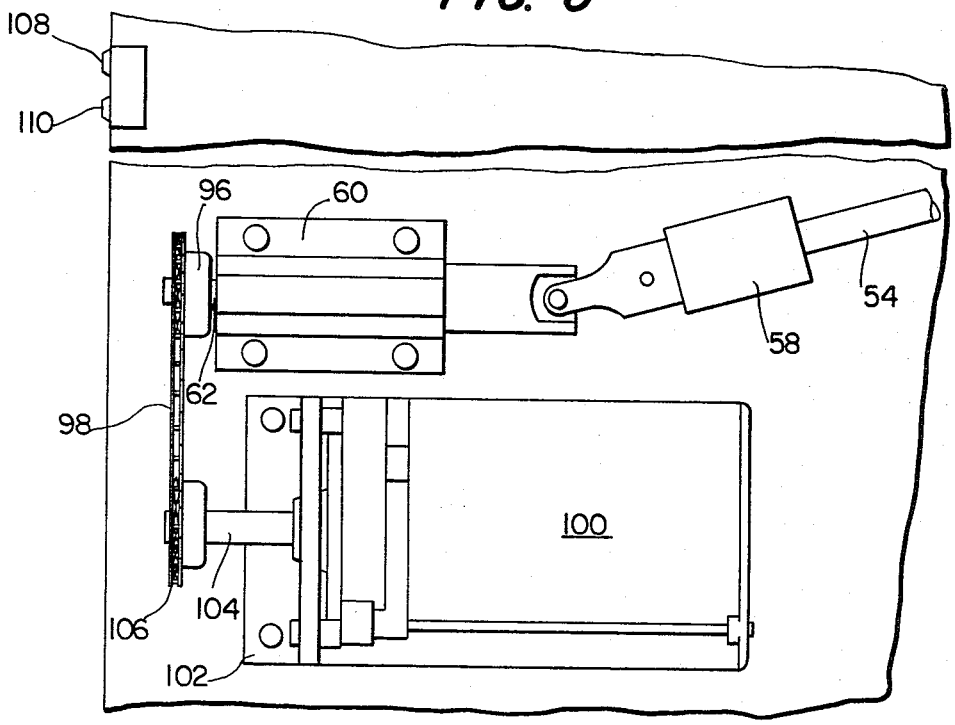

ON THE FLY ADJUSTING MECHANISM FOR ROTARY PRINTING PRESSES

BACKGROUND OF THE INVENTION

1. Field of the Invention

Rotary printing presses, particularly the newspaper type, embodying abutting plate cylinder and impression cylinders. Particularly, a mechanism for offsetting the impression cylinder with respect to the plate cylinder, for webbing up or passing the newsprint web through the printing cylinders. Heretofore, the amount of impression was adjusted by a pivoted bell crank with a turn buckle strut extending to the impression cylinder bushing. The amount of impression or offset was adjusted by turning the turn buckle, so as to lengthen or shorten the strut. It was necessary, of course, to stop the press during adjusting.

According to the present invention, the adjusting may be made "on the fly" and without stopping the press.

2. Description of the Prior Art

Being submitted separately in a Prior Art Statement under 37 C.F.R. 1.97.

SUMMARY OF THE INVENTION

According to the present invention, the impression cylinder and plate cylinder shafts are mounted transversely within a press frame. The impression cylinder shaft is mounted at each end upon eccentric bushing plates, in turn pivoted within the press frame side plates. A bell crank is pivotally mounted in the frame with a follower strut extending from the bell crank to engage each eccentric bushing plate. An articulated longitudinally adjustable link is pivoted on the frame at one end and engages the bell crank at its other end. A piston is provided for engaging and actuating the link, so as to pivot the bell crank and eccentric plate, thereby, bumping the impression cylinder shaft with respect to the plate cylinder. The device may be employed with a press embodying two impression cylinders with follower struts extending from each end of the bell crank to the respective eccentric plates. The adjusting mechanism may include a hand wheel or drive motor for turning a worm contained in the link, so as to adjust the length of the articulated link and, thereby, the degree of pivoting of the bell crank and eccentric plates. This mechanism is designated as an "on the fly" mechanism, since the degree of pivoting or offsetting may be varied while the press is operating.

DESCRIPTION OF THE DRAWINGS

FIG. 3 is a side elevation of the on the fly adjusting mechanism, including the hand crank with adjusting rod extending to the worm drive in the adjustable link mechanism.

FIG. 6 is a front elevation of a modification wherein a motor drive mechanism may be connected to the on the fly adjusting rod.

DESCRIPTION OF THE PREFERRED EMBODIMENTS

Figure 1:
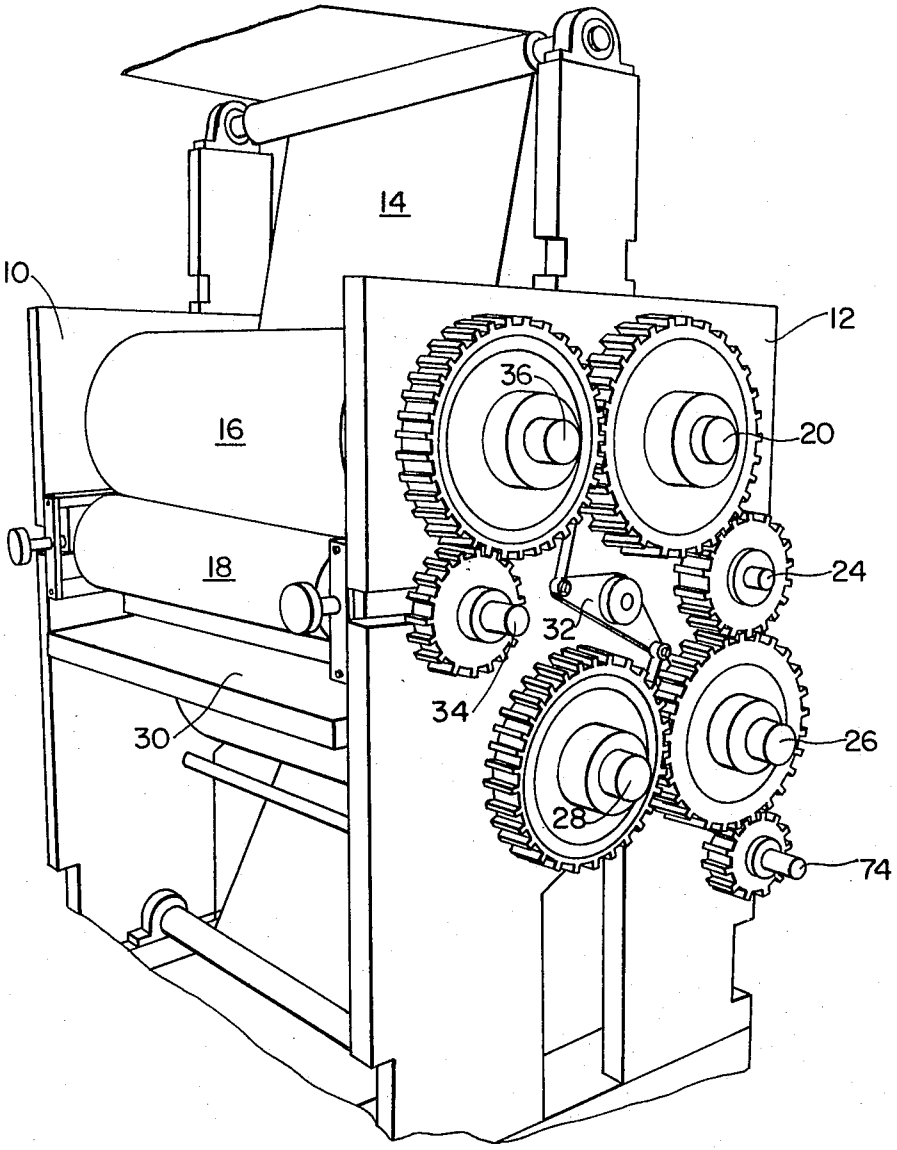
FIG. 1 is a perspective view of a rotary newspaper press, showing at one end an inking roller engaging an upper plate cylinder.

In FIG. 1 a rotary newspaper printing press is illustrated as including side plate members 10 and 12, defining a general frame for support of duplicate series of inking cylinder, plate cylinder and impression cylinder components. Inking cylinder 18 is indicated as supported upon transverse shaft 34 above drip pan 30, so as to engage plate cylinder 16 mounted upon shaft 36. An impression cylinder (not shown) is mounted upon shaft 20, so as to urge the moving web 14 against plate cylinder 16. A second series of inking cylinder shaft 74, plate cylinder shaft 26 and impression cylinder shaft 28 is illustrated at the bottom of the device.

Figure 2:
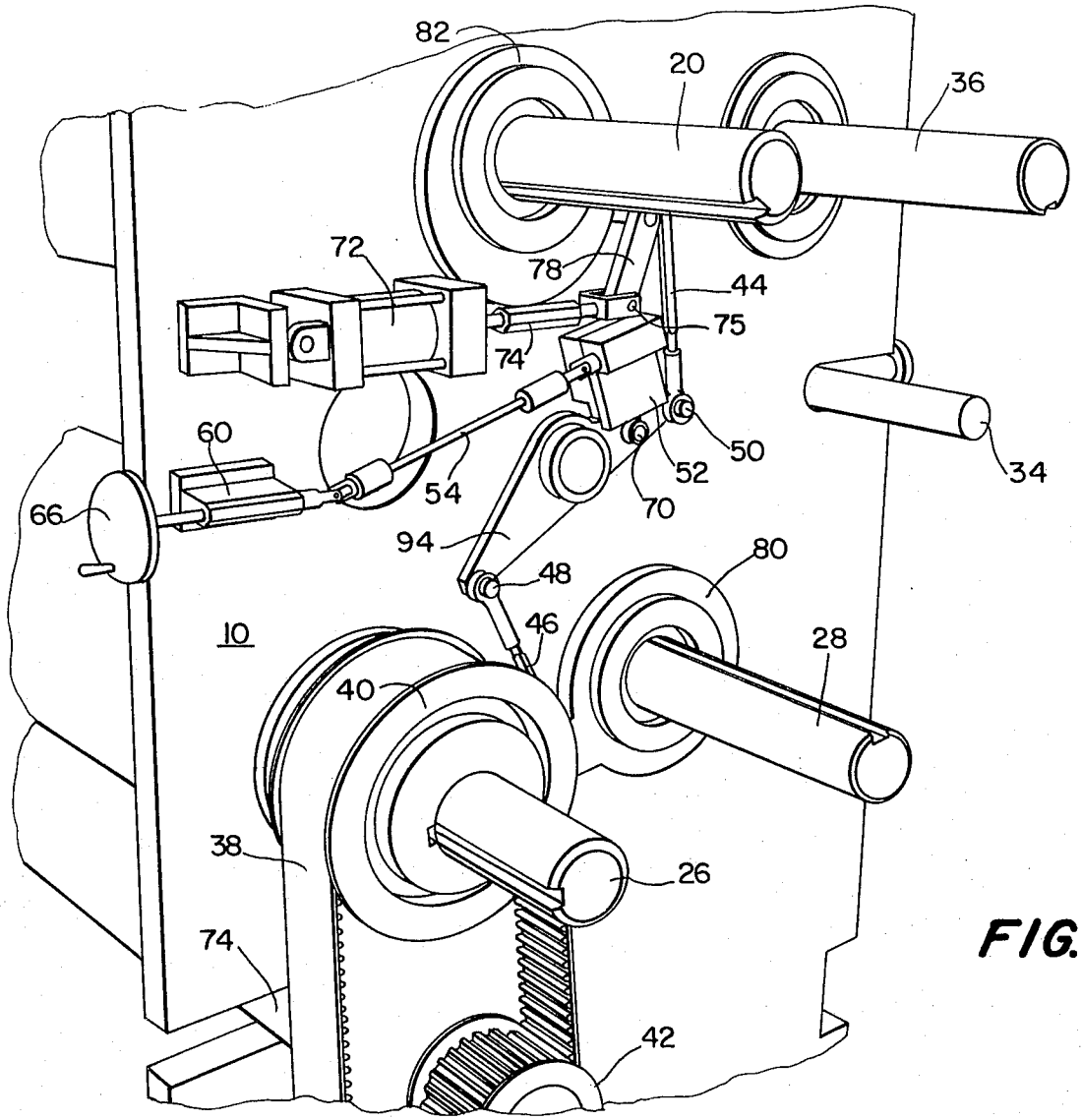
FIG. 2 is an enlarged perspective, taken from the other side of the press, showing the on the fly adjusting mechanism in the form of a bell crank and adjustable link interposed between the respective impression cylinder shaft eccentric plates.

In FIG. 2, the opposed side of the press is illustrated, together with the on the fly adjusting mechanism. Bell crank 94 is illustrated as pivotally mounted in side plate 10 such that follower strut 46, pivotally mounted as at 48, extends downwardly to impression cylinder shaft 28 eccentric plate 80. Follower strut 44, pivotally mounted to bell crank 94 as at 50 extends upwardly to impression cylinder shaft 20 eccentric plate 82. An articulated linkage including upper link 78 is pivoted to one side plate and extends downwardly for engagement with the worm gear housing 52 by means of lower link 68. Housing 52 at its bottom is pivoted as at 70 to bell crank 94.

A pneumatic or hydraulic cylinder 72 includes adjustable shaft 74, extending to engage the articulated link via clevis assembly 75.

As will be apparent, actuation of cylinder 72, so as to horizontally extend shaft 74 results in movement of link 78 and the entire worm housing 52, as an articulated link, thus pivoting bell crank 94. Correspondingly, eccentric plates 80 and 82 are pivoted so as to offset the respective impression cylinder shafts 20, 28 with respect to the respective plate cylinders. This enables change of plates, adjustment of the web or repair without the entire shut down or conventional bumping of the entire press.

Figure 5:
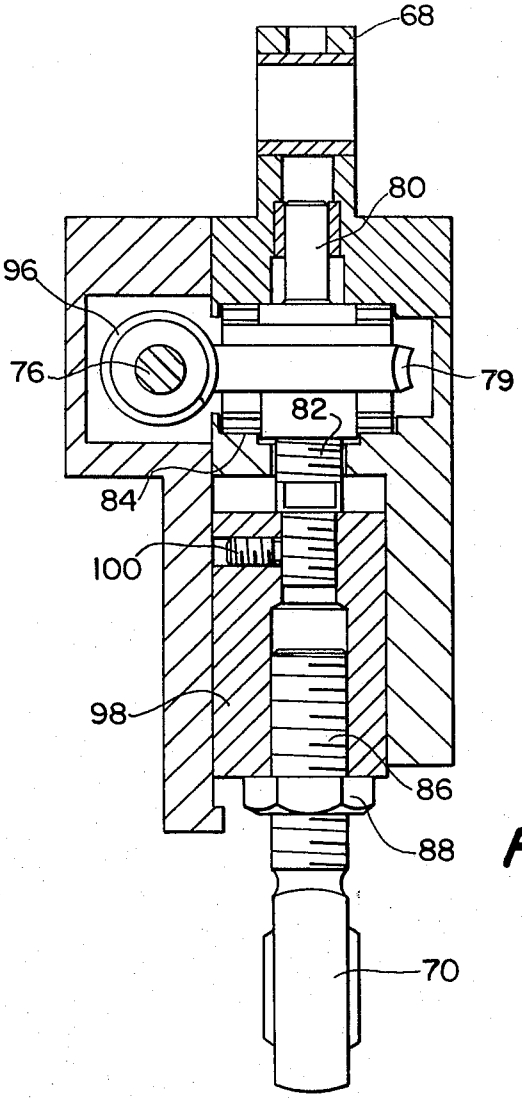
FIG. 5 is a sectional view of the adjustable link housing, taken along section line 5—5 of FIG. 4, and showing in detail the worm drive adjusting mechanism.
Figure 4:
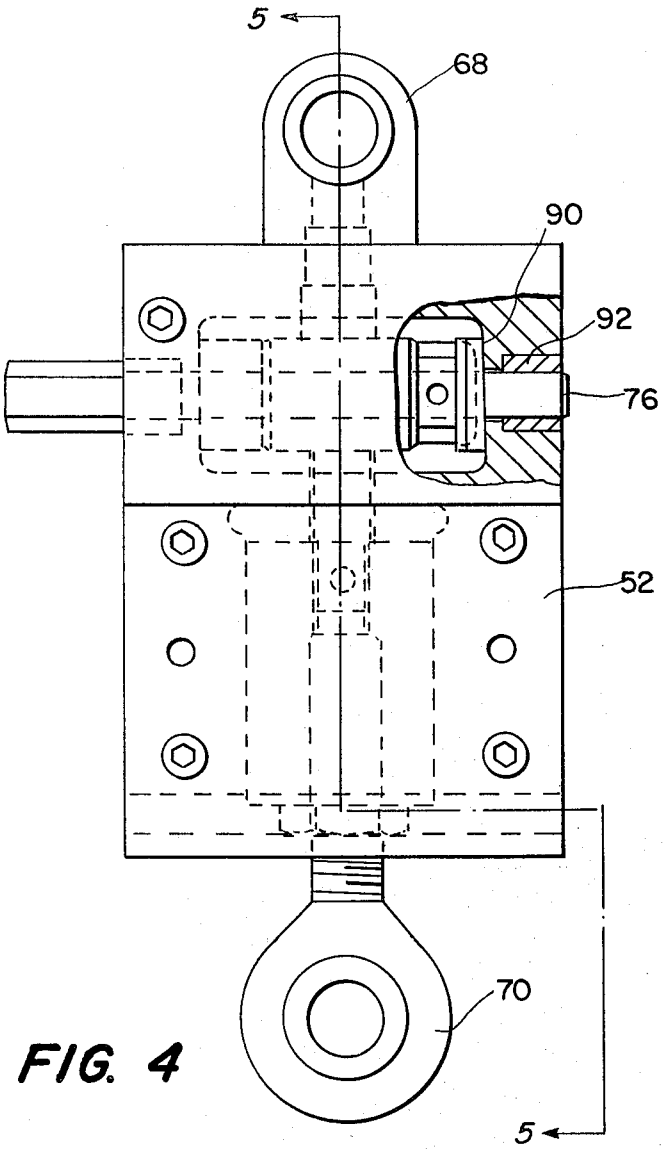
FIG. 4 is a front elevation of the adjustable link housing, showing, in phantom the worm drive and threaded vertical shaft of the link.

As illustrated in FIGS. 3–5, worm gear 78 engages threaded shaft 82 within housing 52. Worm gear 78 is actuated by worm shaft 76 via universal joint extension members 56, 58 and intervening adjusting rod 54. Universal joints 58 and 56 are splined to accommodate change in length of 54, as 52 is cycled. A bearing block 60 may be attached to the frame and include a suitable bushing 62 such that the shaft hand piece extension 64 and manual adjusting wheel 66 may be activated. Alternatively, and as illustrated in FIG. 6, the shaft extension may include driven sprocket 96, driven by chain 98 and drive sprocket 106, affixed to shaft 104. A 1/12 h.p. 90 r.p.m. reversible motor 100 may be mounted upon bracket 102, so as to activate the chain drive and, thus, turn extension rod 54. Motor 100 may be activated by a conventional electric circuit, including momentary contact element forward drive switch 108 and reverse drive switch 110.

As illustrated in FIGS. 4 and 5, shaft 76 may be mounted in suitable bushings 92, thrust bearings and hardened washer assembly 90. Worm wheel shaft 80 includes a threaded portion, the entire worm gear being mounted in thrust bearing and hardened washer assembly 84. A steel worm 96 may encircle shaft 76, so as to engage worm gear 79. Shaft 80 is mounted within slide 98 and held therein by means of socket head set screw 100. A jam nut 88 may be employed to secure threaded shaft 86 with respect to the slide 98.

As will be apparent, activation of crank 66 and movement of worm shaft 76 and steel worm 96 drives worm gear 78, so as to extend the threaded shaft and slide, 98 thereby lengthening the distance between rod end 70 and 68. Lengthening the distance increases the degree of pivot of the bell crank and, thereby, decreases the degree of spacing between the impression cylinder shaft and the plate shaft. Correspondingly, foreshortening of shaft 82 results in an increase of the spacing between the impression cylinder and plate cylinder shafts.

In FIG. 2 a drive mechanism for the rotary press is illustrated as including timing belt 38 engaging timing belt pulley 42 and plate cylinder timing belt pulley 40. The plate cylinder shaft 26 may have corresponding drive gears on the other side of the frame engaging the inking cylinder and impression cylinder shafts, as illustrated in FIG. 1.

Manifestly, the bell crank and eccentric plate mechanisms may be varied without departing from the spirit of the invention.

We claim:

1. In a rotary printing press system of the type embodying a press frame supporting a first series and a second series of inking cylinder, plate cylinder and impression cylinder components, respectively mounted upon parallel shafts, on the fly adjusting mechanism interposed between the frame and the impression cylinder shafts and comprising:

A. A plurality of eccentric bushing plates supported in the press frame so as to engage and support the ends of the impression cylinder shafts, said eccentric bushing plates enclosing corresponding eccentric seats for each of said shafts;

B. A bell crank pivotally supported upon the frame at each end of said shafts and including a first follower strut extending from one end of said bell crank to one of said impression cylinder eccentric plates and a second follower strut extending from the other end of said bell crank to the other eccentric plate, such that pivoting of said bell crank offsets said impression cylinder shafts in said first series and said second series;

C. An articulated link pivoted in said frame at one end and engaging said bell crank at its other end, said articulated link further including:

(i) a longitudinal adjustment mechanism in the form of a threaded shaft engaged by a worm drive gear mechanism, so as to vary the length of a portion of said link and thereby vary the degree of pivoting of said bell crank and said bell crank; and D. A rotatable extension rod supported upon said frame, said rod including a clevis assembly operatively extending to said worm gear mechanism in said adjustable link such that rotations of said rod drives said worm to vary the length of said threaded shaft;

E. Piston actuating means mounted upon the press frame and engaging another portion of said articulated link, so as to pivot said bell crank, together with said eccentric bushing plates, thereby offsetting said impression cylinder shafts with respect to the respective plate cylinders.

2. A rotary printing press on the fly adjusting mechanism as in claim 1, wherein said first series and said second series are superposed with respect to each other, said bell crank followers extending downwardly to a first impression cylinder shaft eccentric plate and upwardly to a second impression cylinder shaft eccentric plate.

3. A rotary printing press on the fly adjusting mechanism, as in claim 2, including a drive motor operatively connected to said extension rod.

* * * * *